United States Patent [19]

Hedberg

[11] Patent Number: 4,528,067

[45] Date of Patent: Jul. 9, 1985

[54] DEVICE FOR WEB REMOVAL FROM A CYLINDER

[76] Inventor: Börje J. Hedberg, Lantmannav. 53, Trollhättan, Sweden

[21] Appl. No.: 497,580

[22] Filed: May 24, 1983

[30] Foreign Application Priority Data

May 25, 1982 [SE] Sweden ..... 8203218

[51] Int. Cl.[3] ..... D21G 5/00

[52] U.S. Cl. ..... 162/281; 15/256.51; 242/72 R

[58] Field of Search ..... 162/281; 15/256.51; 242/72 R

[56] References Cited

U.S. PATENT DOCUMENTS

| | | | |
|---|---|---|---|
| 2,664,792 | 1/1954 | Cook | 162/281 |
| 3,815,839 | 6/1974 | Madachy | 242/72 R |
| 4,213,577 | 7/1980 | Majoor | 242/72 R |

*Primary Examiner*—William Smith

[57] ABSTRACT

The invention relates to a device for a web, which can be removed from a cylinder (3), said web preferably being a paper web. A band-shaped doctor blade (5), which is designed to extend along the mantle surface (3A) of the cylinder, and which is made possible to be fed in the longitudinal direction of the blade, brings about the removal of the web.

The device makes possible a rational and simple forward feed and change of the doctor blade (5), when said blade is worn during its bearing against the mantle surface (3A) of the cylinder, and the time of cost consuming interruptions in connection with the outfeed of the web is thereby reduced, and also the size of the plant is reduced.

The blade (5) can be collected round a winding-up mechanism (13) formed as an expandable chuck (14), which is connected with a driving means, which is adapted to feed the band-shaped doctor blade (5) at such a chosen speed that it moves with a multiple of the time calculated for the wear of the band in order to make possible a reciprocating feed until the calculated degree of wear is reached.

8 Claims, 7 Drawing Figures

DEVICE FOR WEB REMOVAL FROM A CYLINDER

BACKGROUND OF THE INVENTION

The present invention relates to a device for use in connection with a web, to be removed from a cylinder, and comprising a doctor blade, which is designed to extend along the mantle surface of the cylinder and to be fed in its longitudinal direction.

It is in the first place a principal object of the invention to provide a device of the kind mentioned, which makes possible a rational and simple forward feed and replacement of the doctor blade, when it is worn as a result of its bearing against the surface of the mantle of the cylinder, and thereby reduce the time for cost consuming interruptions in connection with the unrolling of for example a paper web, and minimize the size of the plant.

The object is obtained by means of a device according to the present invention, the characteristics of which will be evident from the following description.

BRIEF DESCRIPTION OF THE DRAWINGS

The invention is now described in the following in the form of an example of an embodiment of the same, reference being made to the accompanying drawings, in which.

DETAILED DESCRIPTION OF A PREFERRED EMBODIMENT

Figure 7:
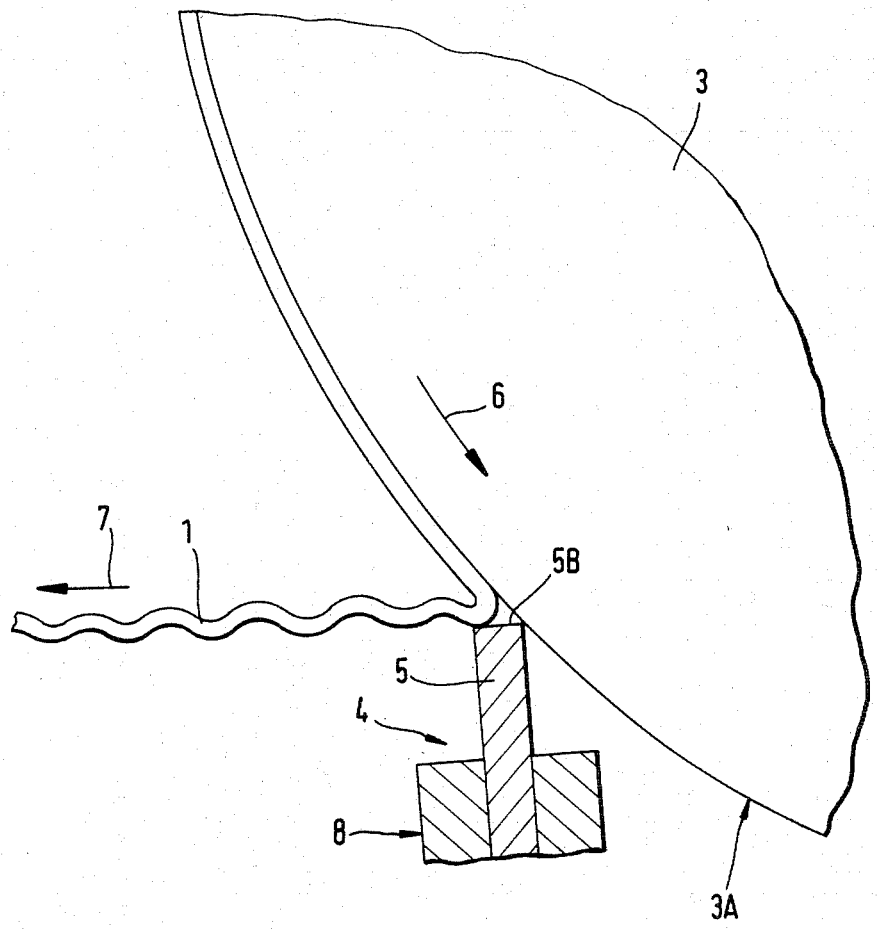
FIG. 7 shows the principle of the removal of the paper web from the cylinder by means of the doctor blade.

A web, in the drawings indicated with the digit 1 (FIG. 7), suitably consists of a material containing paper, preferably soft paper, coming from a paper making machine 2, not shown in detail in the drawings. The web 1 extends along the mantle surface 3A of a rotating cylinder 3, which suitably forms the last element of a drier installation, viz. a yankeecylinder 3 rotatable about an axis 3B. The removal of the paper web 1 is made by means of a doctor device 4, which in known manner comprises a doctor blade 5, that extends along the mantle surface 3A of the cylinder 3, while bearing against the same. The web 1 is thereby removed from the cylinder, when it is fed in the direction of the arrow 6 and rerouted in the direction of the arrow 7. At the same time as the web 1 is removed, it is suitably crimpled, as is shown in FIG. 7.

The doctor device 4, in addition to the doctor blade 5 comprises a doctor body 8, which from each one of the sides of the blade 5 bears against and clamps the same in a groove-shaped cavity 9 of the body 8. A guiding means 10 is suitably provided at each end of the body 8, by means of which guiding means the blade 5 is guided in said cavity 9, when it is fed along the mantle surface 3A of the cylinder in the direction of the arrows 11 and 12 respectively. The blade 5 is formed by a flexible mental band 5 of quite some length, which is preferably made of steel and by way of example has a length of approximately 500 m and a width of about 10 cm.

Figure 1:
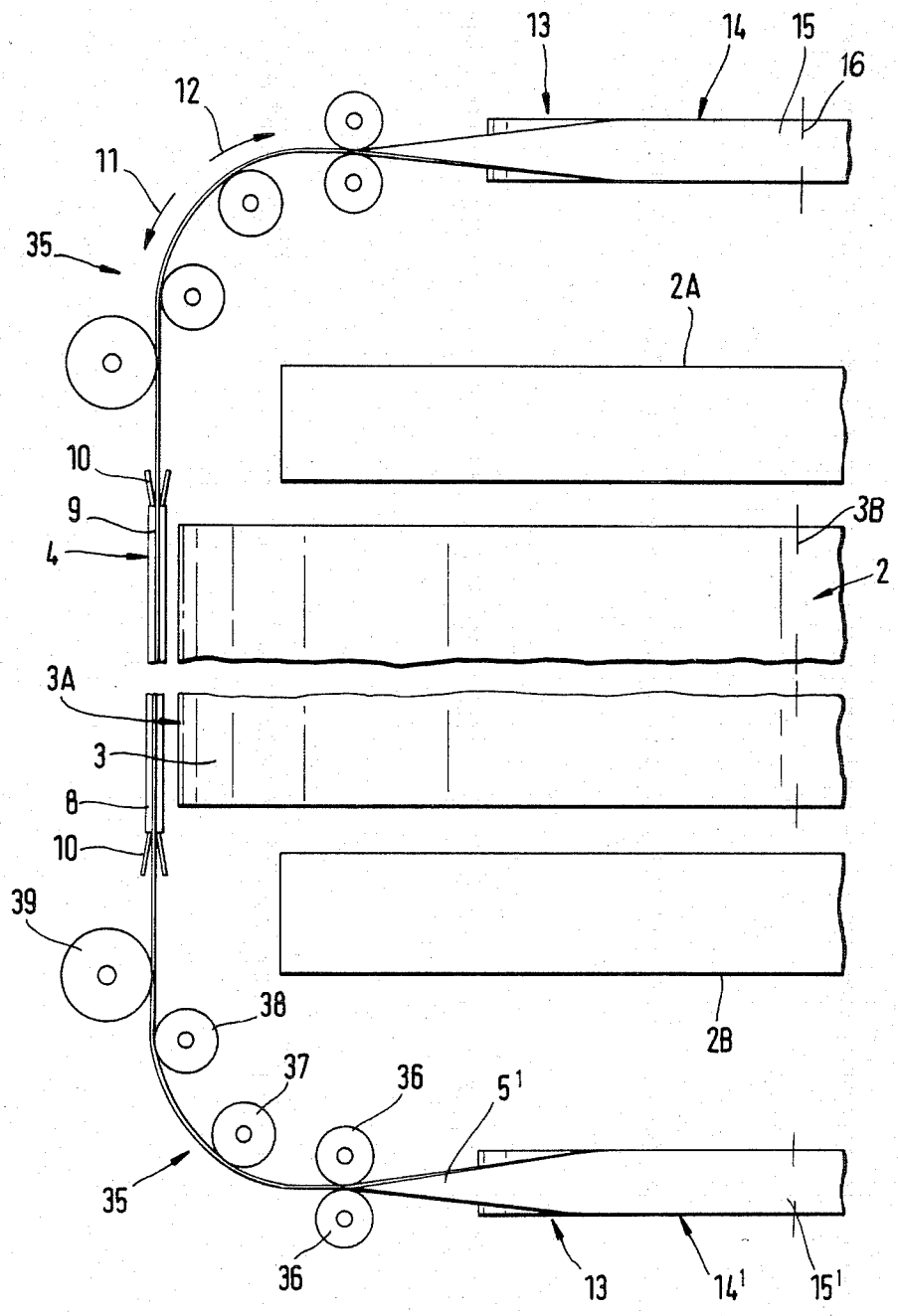
FIG. 1 is a schematical view of a device as seen from above and made in accordance with the present invention.
Figure 2:
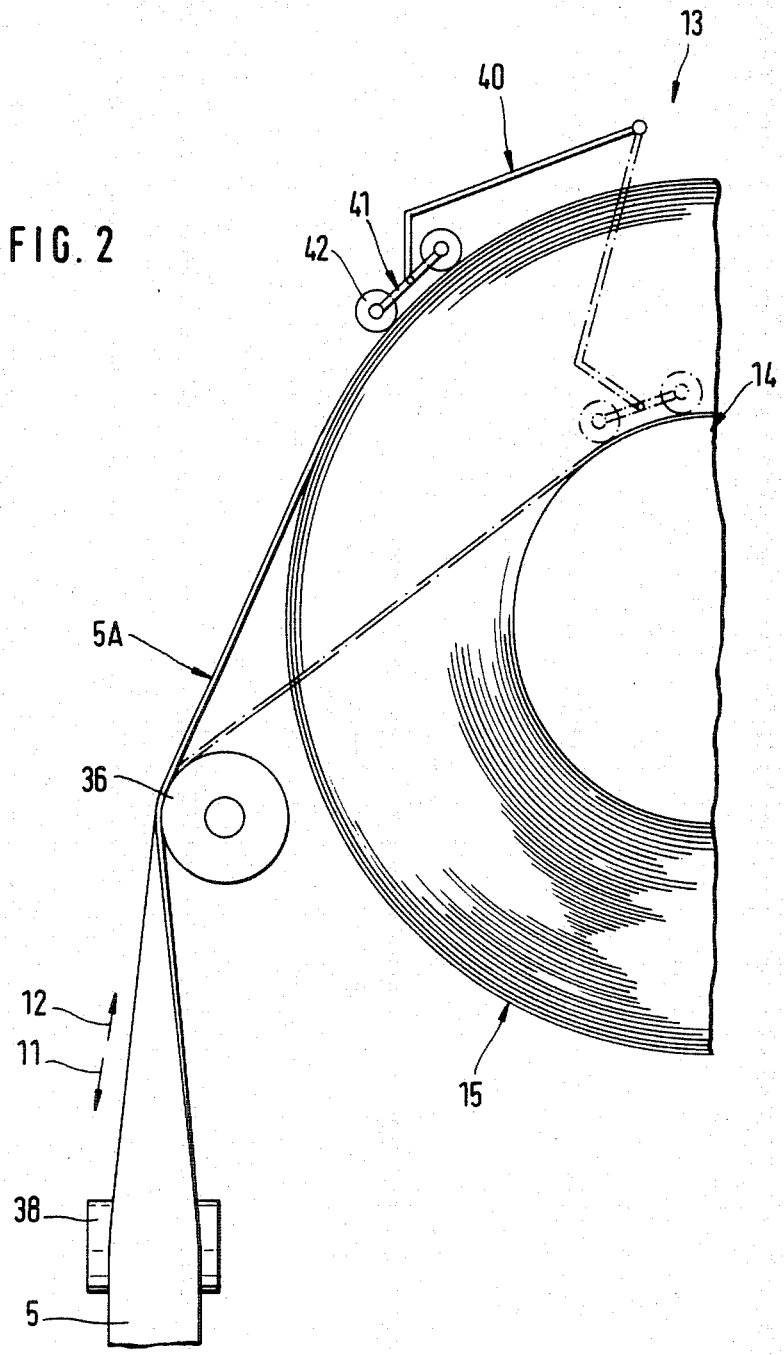
FIG. 2 is a partial view of a rerouting and rolling-up mechanism forming part of the device.
Figure 3:
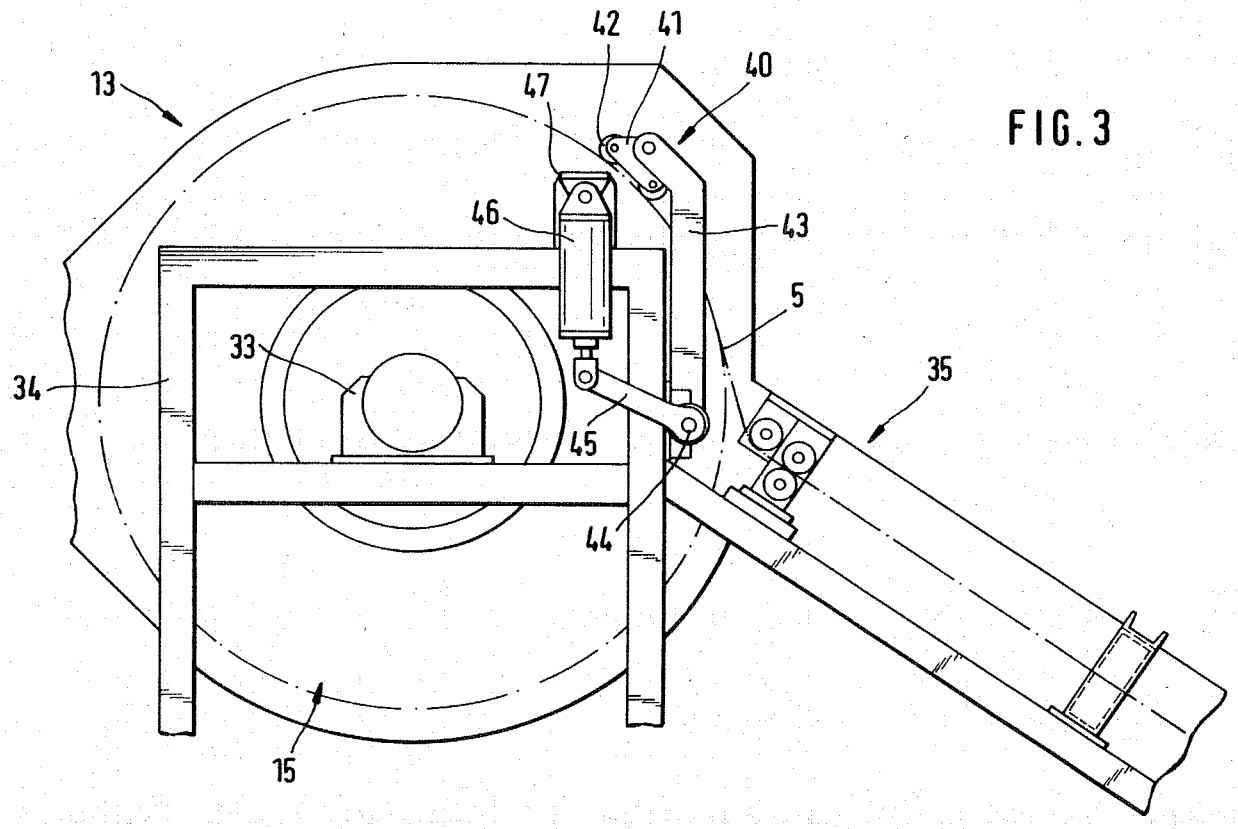
FIG. 3 is a view of the rerouting and rolling-up mechanism as seen in the direction away from one side of the cylinder.

At each one of the end walls of the cylinder 3 there is a rolling-up mechanism 13, in which the band blade 5 is intended to be wound up on a spool 14, 14' and to be unwound from the same respectively. Each spool 14 is in the example of embodiment described formed by an expandable chuck 14, which facilitates a rapid application and removal respectively of a blade bandreel 15 on and off the spool 14 respectively. The central axis 16 of said spool 14 is suitably arranged to extend in alignment with the central axis 3B of the cylinder, as is illustrated in FIG. 1. By this arrangement it is made possible to collect a big reel 15 at the machine 2 without the length of the machine having to be increased to any large extent, as the reels 15 and 15[1] respectively instead will be arranged to extend along the laterals 2A and 2B respectively of the machine.

Figure 4:
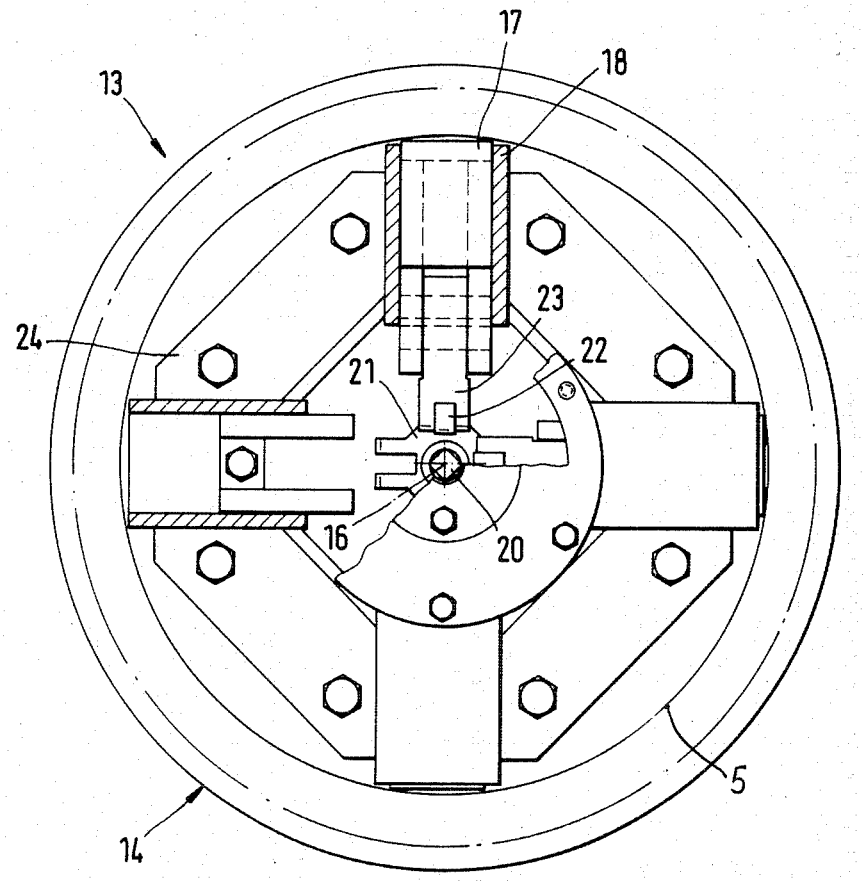
FIG. 4 is a view of a chuck of a band spool forming part of the rolling-up mechanism and seen along its central axis.
Figure 5:
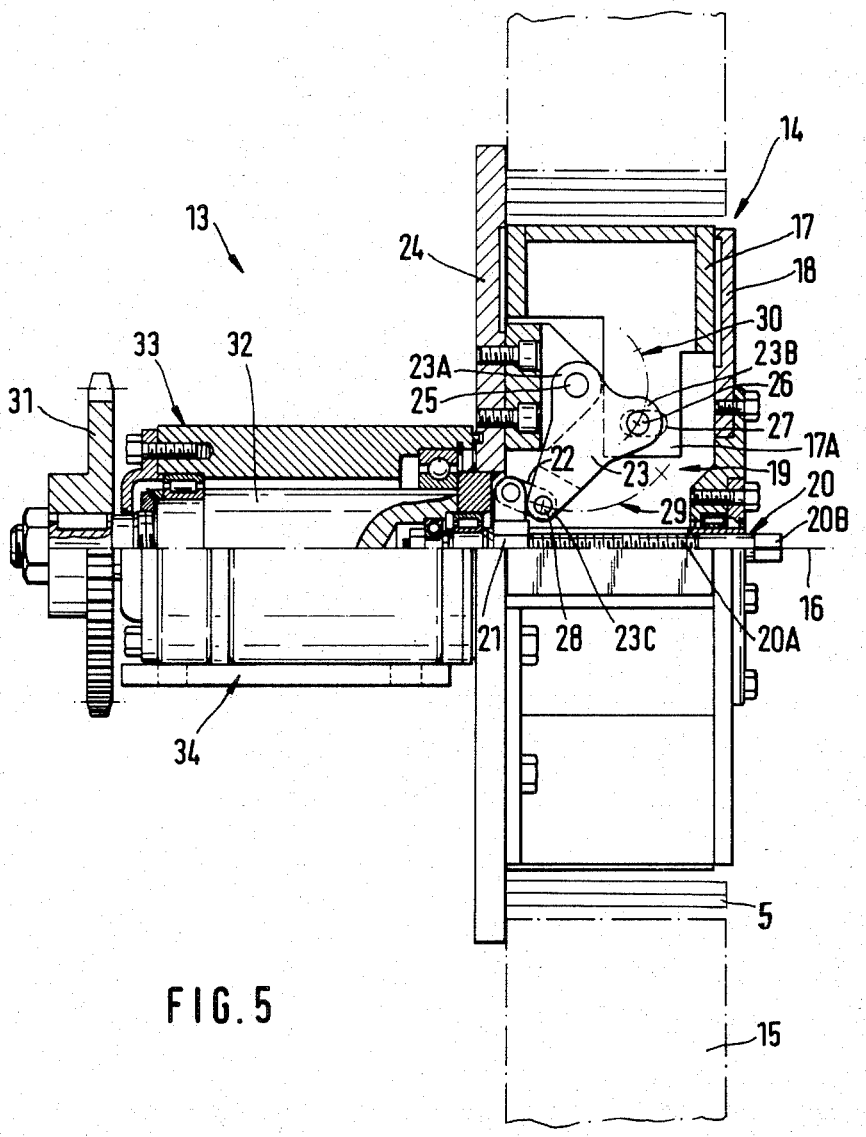
FIG. 5 is a view of the spool chuck in a partly shown cross-section.
Figure 6:
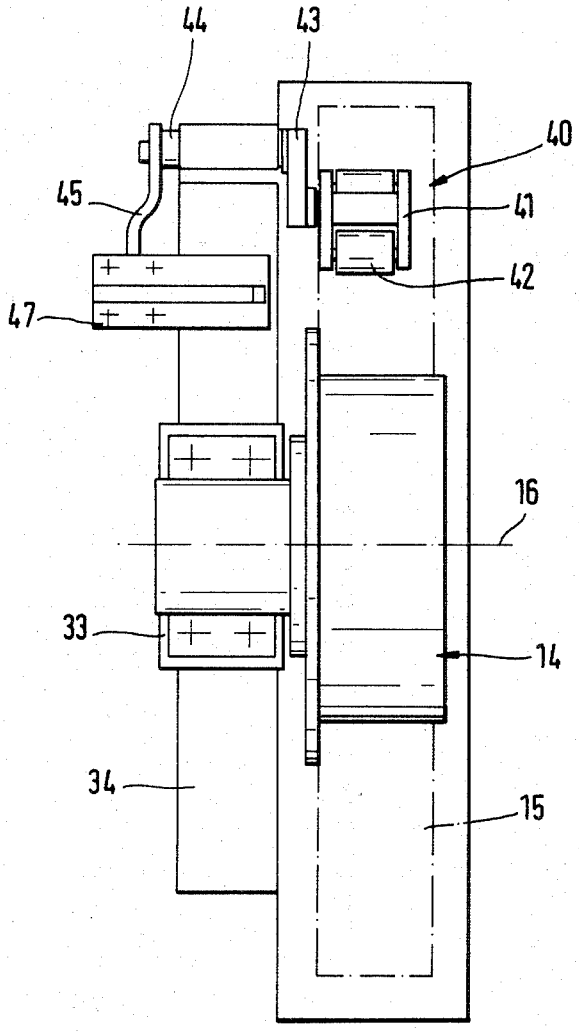
FIG. 6 is a view of the rolling-up mechanism as seen from above.

The expandable spool 14, as is evident from the FIGS. 4 and 5, comprises a number of pistons 17, which are evenly distributed around the central axis 16. Each piston 17 is received in a cylinder-shaped guiding means 18, which is arranged to guide the piston 17 during its displacement between its two end positions respectively.

An actuating mechanism 19, by means of which said pistons 17 can be manually guided between said two end positions of a piston, may comprise a threaded shaft 20, along the threaded portion 20A of which at least one nut 21 can be displaced, when the free not round end portion 20B of the shaft is actuated, said end portion 20B being adapted to cooperate with a wrench or similar tool. The nut 21 is via rerouting means 22 pivoted to each piston by a pivoting arm 23.

Each pivoting arm 23 is via a pivot 25 pivoted on the frame 24 of the spool 14, said pivot extending through one end portion 23A of the arm. An additional end portion 23B of the pivoting arm 23, which is preferably shaped as the point of an arrow, is via an articulation 26 formed of a pivot 26 connected with the respective piston 17 belonging thereto. The pivot 26 is arranged to permit being displaced along a groove 27, which extends transversally to the piston 17 in a lateral wall portion 17A of the piston, which is facing the central axis 16. When the shaft 20 is rotated in one direction, the nut 21 is displaced along the shaft 20 from one of its ends, the respective rerouting means 22 then actuating the respective pivoting arm 23 belonging thereto making it pivot around the articulation 25. The additionally arranged articulation 28, which connects the rerouting means 22 with the end portion 23C of the pivoting arm facing the shaft 20, is then moved along the arc 29, while the pivot 26 is moved along the arc 30. The piston 17 is then caused to move in an outwards direction away from the central axis 16, and in said projecting position to form a core for the spool 14 of the band 5, which is wound up on the same and unwound therefrom respectively. By rotating the shaft 20 in opposite direction the nut 21 moves backwards to the position illustrated in FIG. 5, the pistons 17 moving inwards towards the central axis 16 in the respective guiding means 18 belonging thereto.

The drive of the spool 14 can be brought about by means of a driving means, not shown in the drawings, which by way of example via a sprocket wheel 31 is connected with the spool 14 via a shaft 32 and a bearing means 33, and is supported by a roller frame 34.

In the space between the doctor device 4 and a bandreel 15 and 15[1] respectively there is a rerouting mechanism 35, which is designed in such a manner that it reroutes the band 5 by approximately 90°, when it is moved around a reel 15 to the doctor device 4 and from the doctor device 4 to a reel 15[1] respectively.

The rerouting mechanism 35 is suitably formed by a number of rotatable rollers 36–39, which in the space between them and along the mantle surfaces of the rollers respectively by mechanically operated means reroutes the band 5 of the blade, so that it will be possible for the same to gradually pivot and be rerouted and guided from a reel 15, 15[1] and into the cavity 9 of the doctor body 8 and back again respectively and by this arrangement make possible said favorable location of the reels 15, 15[1], so that they can be placed crosswise relative to the cylinder 3.

A band guiding means 40 is located at the respective reel storage place 34 in order to provide an efficient winding-up and unwinding respectively of the band 5 to and from respectively reel 15, 15[1]. Said guiding means 40 can be formed by a carriage-like holding device 41, which supports a number of roller means 42, which are designed to bear against the outside 5A of the band 5 and press the same against the reel 15, 15[1]. The reel holding device 41 is at one end supported by a pivoting arm 43, which at its opposite end is pivoted on a pivoting shaft 44. The pivoting shaft 44 is in its turn rigidly connected with a lever arm 45, which is connected with one end of a preferably pneumatic power cylinder 46, which is supported by a fixture 47 rigidly connected with the frame 34. A change of the length of the cylinder 46 brings in its train a pivoting of the arm 43 in a direction towards or away from the reel 15, 15[1] and as a result thereof a pressing of the band 5 and release of the reel 15, 15[1] respectively.

The band 5 is designed to be continuously fed from one of the spools 14, which is located on one side of the cylinder, to the other spool 14[1], which is supported on the other side of the cylinder. The band 5 is suitably fed with such a chosen speed that it will be a multiple, by way of example one fourth, of the time, which is calculated for the wearing out of the band 5. The band 5 can thus be fed in reciprocating movement through the doctor holder 8, until the band 5 due to its bearing against the mantle surface 3A of the cylinder 3 has been worn out to the calculated degree. If a multiple of one fourth has been chosen, the band 5 can be fed back and forth twice. By said chosen gradual wear of the band 5 an advantageous and acceptable web contact surface 5B of the band 5 can be obtained during the whole period of time of its use as distinguished from an operation involving a feed of a band at such a speed that the band is immediately completely worn out. Said favorable result is made possible thanks to the wear of the band along the doctor holder 8 being gradually changed, thus not taking place in one single phase to the limit of its complete wearing out, in which latter case the band has to be scrapped.

When the band 5, which is supported on a spool 14 in the form of a reel 15, is completely worn out, the end portion of said blade 5 is connected with the free starting end of a new blade 5[1], which suitably is kept collected in the form of a reel 15[1], which in a clamped condition is supported on the spool 14[1], this suitably taking place before the blade 5 has passed through the doctor holder 8. When said starting end has been fed forward, so that it is transferred to the other spool 14, the reel 15, which then contains the worn out band 5, is disconnected, and a new reel is arranged to be wound up on said free reel 14 and be locked on the same thanks to the expandable chuck 14. In connection with said change of blade reels 15, 15[1] and coupling of band ends there can arise an interruption of approximately 10–20 seconds. However, said interruption can be neglected, as it only occurs about every 12th to 15th period of twentyfour hours of operation.

The doctor body suitably has a number of displaceable bearing bodies by means of which the lifted up position of the blade in the holder 4 can be made adjustable, which is a necessity because of the successive wear of the blade.

The invention is not limited to the example of embodiment shown in the drawings and described above, but can be varied as to its details within the scope of the following claims.

I claim:

1. A device for removing a web from a cylinder, comprising: a band-shaped doctor blade, means for guiding said doctor blade along the mantle surface of the cylinder, first and second winding-up mechanisms for the blade, respectively arranged on opposite sides of the cylinder, each winding-up mechanism having an expandable chuck with an axis of rotation extending in the same direction as the axis of rotation of said cylinder, and driving means connected to said winding-up mechanisms for feeding the doctor blade from a spool on the chuck of the first winding-up mechanism on one side of the cylinder to a second chuck on the second winding-up mechanism on the other side of the cylinder, and vice versa.

2. A device according to claim 1, wherein each chuck has at least one radial expansion device in the form of a piston.

3. A device according to claim 1, comprising a first and second rerouting mechanism for said doctor blade and respectively located in the space between the first and second winding-up mechanism and said guiding means.

4. A device according to claim 3, wherein each rerouting mechanism comprises a plurality of rollers for mechanically turning the blade from an essentially vertical position when said doctor blade leaves said guiding means to a substantially horizontal position permitting winding of the blade on the respective chuck.

5. A device according to claim 1, comprising means for connecting a starting end of the doctor blade with an additional blade on said chuck of one of said winding-up mechanisms.

6. A device according to claim 1, comprising first and second band guiding means respectively located adjacent the respective chuck of said first and second winding-up mechanism for respectively facilitating winding and unwinding of the band from the chuck.

7. A device according to claim 6, wherein each band guiding means comprises a carriage-like holder supporting a plurality of rollers of bearing against the band and press the same against the chuck.

8. A device according to claim 7, comprising a pivoting arm having one end for supporting said holder and an opposite end pivotally connected to a pivoting shaft, and a power actuated arm connected to said pivoting shaft for pivoting said arm for pressing a blade against the chuck and for releasing the same, respectively.

* * * * *